US008667813B2

(12) United States Patent
Cook

(10) Patent No.: US 8,667,813 B2
(45) Date of Patent: Mar. 11, 2014

(54) MULTI-SIZE ADJUSTABLE CASTINGS FOR JEWELRY

(76) Inventor: Darla D. Cook, Battle Creek, MI (US)

( * ) Notice: Subject to any disclaimer, the term of this patent is extended or adjusted under 35 U.S.C. 154(b) by 53 days.

(21) Appl. No.: 13/423,389

(22) Filed: Mar. 19, 2012

(65) Prior Publication Data

US 2012/0174627 A1 Jul. 12, 2012

Related U.S. Application Data

(63) Continuation-in-part of application No. 11/409,528, filed on Aug. 14, 2006, now abandoned.

(51) Int. Cl.
*A44C 17/02* (2006.01)

(52) U.S. Cl.
USPC ..... 63/29.1; 29/10

(58) Field of Classification Search
None
See application file for complete search history.

(56) References Cited

U.S. PATENT DOCUMENTS

| | | | | |
|---|---|---|---|---|
| 1,012,501 | A | 12/1911 | Alsop | |
| 1,053,539 | A | 2/1913 | Schlechter | |
| 1,056,054 | A | 3/1913 | Pulaski | |
| 1,382,867 | A | 6/1921 | Stone | |
| 2,028,284 | A | 1/1936 | Jackson | |
| 6,568,213 | B2 * | 5/2003 | Butler | 63/26 |

FOREIGN PATENT DOCUMENTS

GB 2 218 319 A 11/1989

* cited by examiner

*Primary Examiner* — Jack W. Lavinder
(74) *Attorney, Agent, or Firm* — Flynn, Thiel, Boutell & Tanis, P.C.

(57) ABSTRACT

An adjustable jewelry head or casting is provided. The head includes a track and a plurality of mounting members, at least one of which is slideable along the track. One or more pins connect the mounting members to the track. The pins are moveable to allow sliding adjustment of the mounting members with respect to one another.

1 Claim, 7 Drawing Sheets

MULTI-SIZE ADJUSTABLE CASTINGS FOR JEWELRY

CROSS REFERENCE TO RELATED APPLICATIONS

This is a continuation-in-part of prior U.S. application Ser. No. 11/409 528, filed Aug. 14, 2006 now abandoned.

BACKGROUND OF THE INVENTION

There are many different shapes and sizes of gems. A separate casting is typically required for every gem that is purchased, which can be costly and time consuming.

An embodiment of the present invention comprises a casting, or head, that is adjustable to fit several different sizes of gemstones, using only one head. The head is configured and adjustable to receive princess and emerald cut gems, among others.

The head resides on a spring slide in order to hold a gem tight. A release mechanism enables the slide to be moved to a desired position and to tighten and hold a gem in place. A tool may be employed to move the spring slide into place and when the tool is removed, the gem is locked in place in the head.

The head may be used for rings, earrings, necklaces, bracelets, and broaches, as well as other jewelry items. It allows switching a gem for whatever reason desired or needed, such as to match gemstones with different outfits. Moreover, the novel jewelry head can be used for several different sized and shaped stones, thus reducing costs for jewelry.

Other advantages, objects and/or purposes of the invention will be apparent to persons familiar with constructions of this general type upon reading the following specification and inspecting the accompanying drawings.

BRIEF DESCRIPTION OF THE DRAWING FIGURES

DETAILED DESCRIPTION OF THE PREFERRED EMBODIMENTS

An embodiment of the novel invention is generally a piece of jewelry, such as a ring, with an adjustable head or casting. The jewelry may be other items such as earrings, necklaces, bracelets, and broaches, as well.

Figure 2:
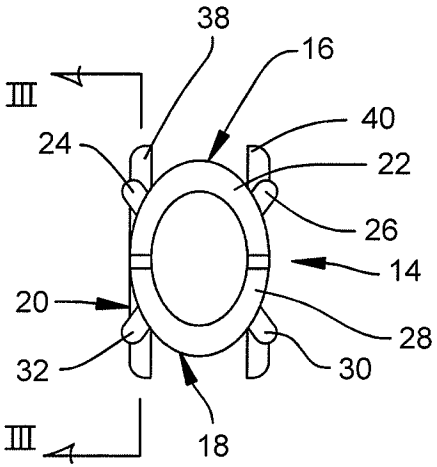
FIG. 2 is a top plan view of the jewelry head of FIG. 1.
Figure 1:
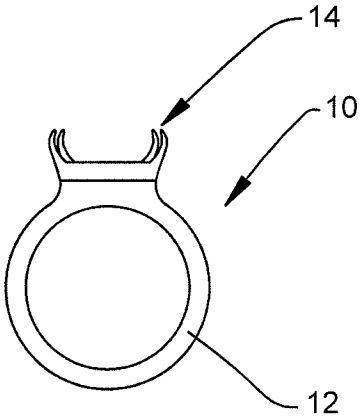
FIG. 1 is an elevational view of a ring comprising a jewelry head embodying the present invention.

FIG. 1 shows a ring 10, which generally includes a shank 12 and a head 14. As shown in FIG. 2, the head 14 includes a first claw portion 16, a second claw portion 18, and a track 20.

The first claw portion 16 includes a first bezel member 22, which is preferably in the general shape of a semi-circle or horseshoe. Extending upwardly from the first bezel member 22 are two prongs 24, 26. The prongs 24, 26 are fixedly attached to the first bezel member 22 and are positioned generally on opposite sides of the first bezel member. The second claw portion 18 comprises a second bezel member 28 and two prongs 30, 32 extending upwardly from the second bezel member 28. The second bezel member 28 is preferably shaped as a semi-circle or horseshoe and is a mirror image of the first bezel member 22. Prongs 30, 32 are fixedly attached to, and extend upwardly from, the second bezel member 28 and are positioned generally on opposite sides of the second bezel member 28. The first claw portion and the second claw portion 16, 18 are positioned opposing one another, and together define a complete claw and bezel arrangement for setting a gemstone therein.

Figure 3:
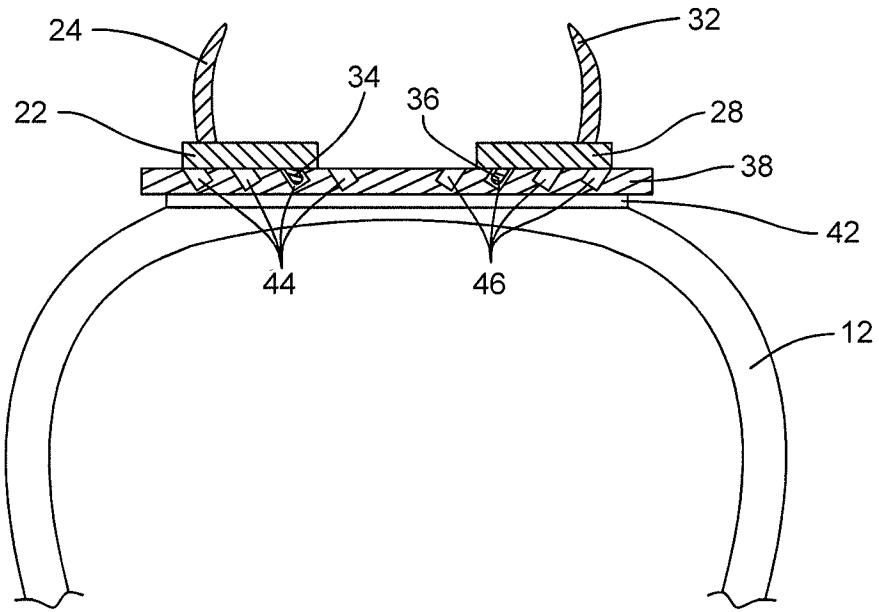
FIG. 3 is a cross-sectional elevational view of the jewelry head of FIG. 1, taken along line in FIG. 2.

As shown in FIG. 3, depending from first bezel member 22 are two pins 34, which are preferably at an angle other than 90° with respect to the longitudinal direction of the first bezel member 22. Likewise, two pins 36 depend from second bezel member 28, and are preferably at an angle other than 90° with respect to the longitudinal direction of the second bezel member 28. Pins 34 are on opposite sides of first bezel member 22, and pins 36 are on opposite sides of second bezel member 28.

Figure 4:
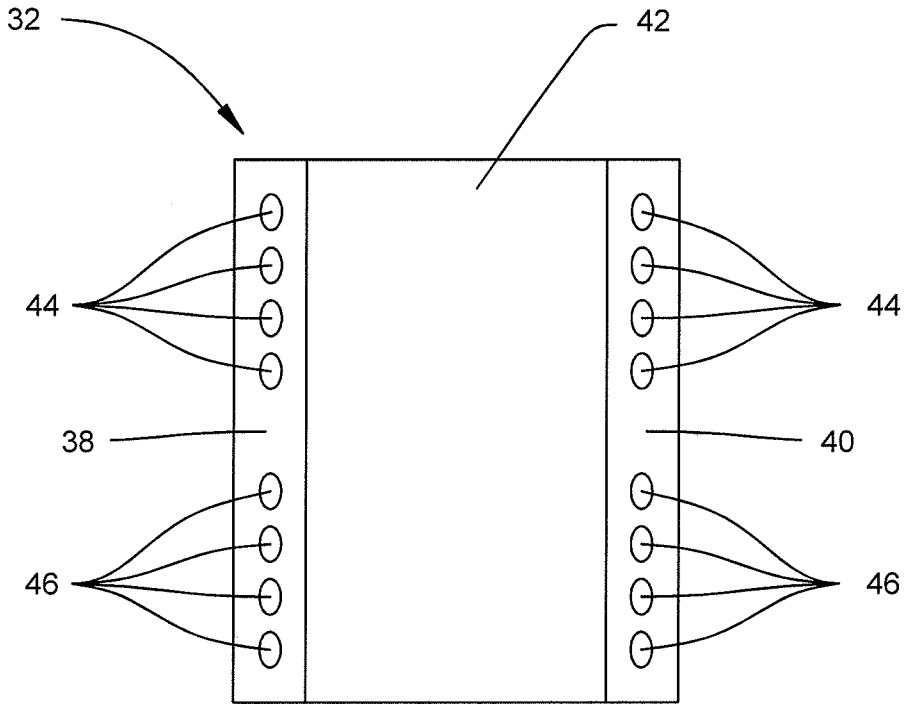
FIG. 4 is a top plan view of a track portion of the jewelry head of FIG. 1.

The track 20 includes a first track member 38 and a second track member 40. The first track member 38 and second track member 40 are preferably elongated and parallel to one another. The first bezel member 22 and second bezel member 28 ride along both first track member 38 and second track member 40. See FIG. 3. The first track member 38 and second track member 40 are attached to a base 42 which is in turn attached to the shank 12 or other jewelry member. Each of the first track member 38 and second track member 40 has apertures therein, in which the pins 34 or 36 will fit. As shown in FIG. 3, first track member 38 has two sets of apertures 44, 46. Second track member 40 also has two sets of apertures, which are preferably identical to those of track member 38. Apertures 44 extend in a direction at an angle with respect to the longitudinal axis of the rail 38. A preferred angle is 45° but it is contemplated that other angles may be employed. Preferably, apertures 46 are also at an angle with respect to the longitudinal axis of the first track member 38, such as 45°, and at the same angle, but in the opposite direction, with respect to apertures 44, as shown in FIG. 3. The angles of the apertures 44 and 46 are preferably at the same angle with respect to the longitudinal axis of the first track member 38 as the respective angles of the pins 34 and 36 are with respect to the first bezel member 22 and second bezel member 28, respectively. Second track member 40 also preferably has the same angle of apertures as first track member 38 such that the pins 34, 36 on the opposing side of the first bezel member 22 and second bezel member 28 will extend into such apertures. FIG. 4 shows an overhead view of the track 20 and the relative positions of the apertures in tracks 38, 40. Pins 34, 36 friction fit into apertures 44, 46, or are held in place by other means such as one or more springs attached to both the first bezel member 22 and the second bezel member 28.

Figure 5:
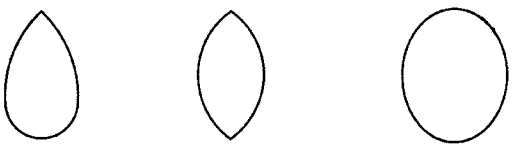
FIG. 5 is a top plan view of three different shapes of gemstones which may be used in the jewelry head of FIG. 1.

FIG. 5 shows a variety of shapes of gemstones that may be used with the jewelry head of the FIG. 1-4 embodiment.

Figure 7:
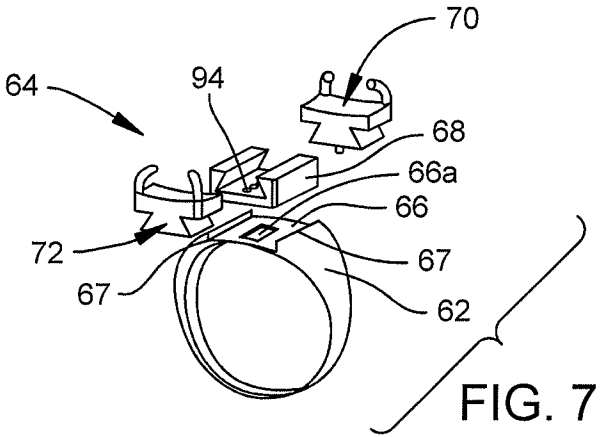
FIG. 7 is a perspective exploded view of the ring of FIG. 6.
Figure 6:
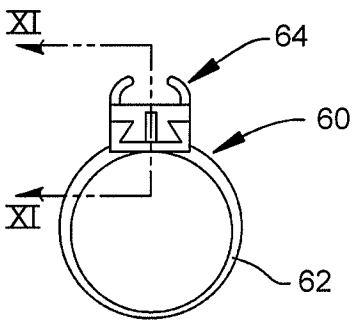
FIG. 6 is an elevational view of a ring comprising a jewelry head of a second embodiment of the present invention.

FIGS. 6-10 depict a second and preferred embodiment of the novel jewelry head. FIG. 6 shows a ring 60 that includes this head. The ring 60 comprises a shank 62 and a jewelry head 64 attached to the shank 62. As shown in FIG. 7, the shank 62 includes a flat upper surface 66 which is defined by opposing lips 67. An aperture 66*a*, preferably elongated and centrally positioned, extends through the flat upper surface 66.

Figure 8:
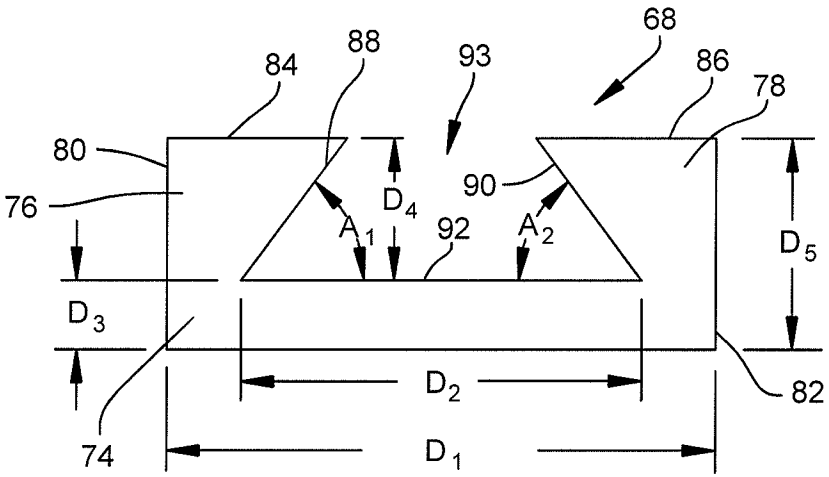
FIG. 8 is an end elevational view of a track portion of the jewelry head of FIG. 6.

The head 64 includes a track 68, a first mounting member 70, and a second mounting member 72. As shown in FIG. 8, the track 68 has a substantially uniform base 74 which defines the bottom of the track 68. The base is sized and shaped to fit on the upper flat surface 66 of the shank 62, between lips 67. The bottom of the track 68 is preferably fixedly attached to the upper flat surface 66 and/or lips 67. The base 74 also defines an inner slideable surface 92, which is preferably flat and extends the entire length of the base 74. Extending upwardly from each side of the base 74 is a wall member. On one side of the base 74 there is a first wall member 76, and on the opposing side of the base 74 there is a second wall member 78. The wall members 76, 78 are substantially mirror images with respect to one another as they are positioned on the base 74 of the track 68. Together base 74 and first wall member 76 define a first outer wall surface 80, and base 74 and second wall member 78 define a second outer wall surface 82. First wall member 76 also defines a first top surface 84, and second wall member 78 defines a second top surface 86. First top surface 84 and second top surface 86 are preferably both flat and in the same plane as one another. First wall member 76 also defines a first inner wall surface 88, and second wall member 78 defines a second inner wall surface 90. The first inner wall surface is transverse to, and at an angle other than 90° with respect to, both the plane in which first outer wall surface 80 exists and the plane in which the slideable surface 92 resides. The angle between the first inner wall surface 88 and the slideable surface 92 is depicted as $A_1$ in FIG. 8. The second inner wall 90 is also transverse to, and at an angle other than 90° with respect to, the plane in which second outer wall surface 82 exists and the plane in which the slideable surface 92 resides. The angle between the second inner wall 90 and the slideable surface 92 is depicted as $A_2$ in FIG. 8. Most preferably the $A_1$ angle and the $A_2$ angle are identical. The angles $A_1$, $A_2$ are each preferably in the range of 50°-60° and more preferably about 55°.

The overall width of the track 68 is depicted as $D_1$ in FIG. 8; the width of the slideable surface is depicted as $D_2$; the height of the base is depicted as $D_3$, the height of the first wall member 76 (and the second wall member 78) is depicted as $D_4$; and the overall height of the track 68 (that is $D_3+D_4$) is depicted as $D_5$. Preferably, the ratio of the height of the first wall member 76 and second wall member 78 to the height of the base 74 (that is, $D_4$:$D_3$) is 2 to 1. Also, the ratio of the distances of the width of the slideable surface 92 to the height of the track 68 (that is, $D_2$:$D_5$) is preferably 2 to 1. In addition, the ratio of the width of the slideable surface 92 to the height of the first wall member 76 and the second wall member 78 (that is, $D_2$:$D_4$) is preferably 3 to 1. Moreover, the length dimension of the width of the track 68 to the width of the slideable surface 92 (that is $D_1$:$D_2$) is preferably 4 to 3.

The shape of the resulting inner space 93 of the track member 68 is that of a female portion of a dove tail joint, and along with parts of the track 68 is a holding structure for retaining one or more mounting members. However, it is contemplated that other shapes and length dimension ratios may be used.

Figure 9:
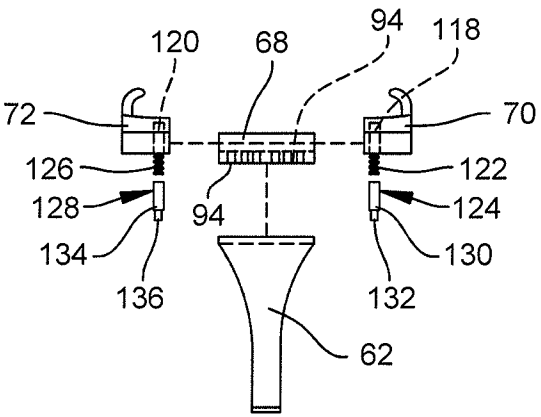
FIG. 9 is a side elevational exploded view of the ring of FIG. 6.

As shown in FIGS. 7 and 9, the track 68 has a plurality of apertures 94 which preferably extend along the central longitudinal axis of the track 68, and are equally spaced from one another. The apertures 94 each extend through the entire height $D_3$ of the base 74 of the track 68, and are sized and shaped to receive a portion of a pin, which is discussed in more detail below.

Figure 10:
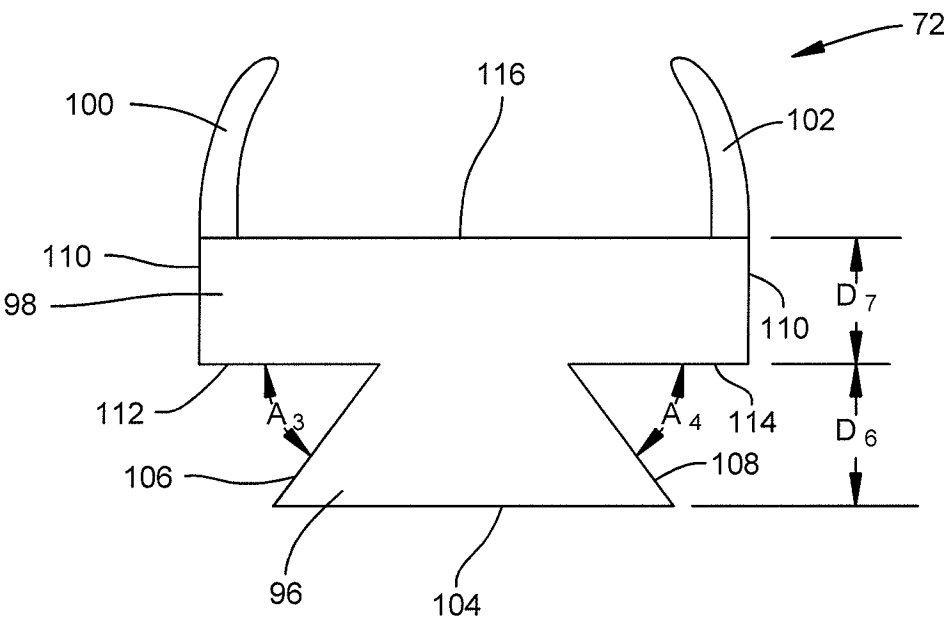
FIG. 10 is an end elevational view of a mounting member of the jewelry head of FIG. 6.

FIG. 10 shows an end view of second mounting member 72. The mounting members 70, 72 each have a bottom member 96 which is connected to or integral with a bezel portion 98. Extending upwardly from one side of the bezel portion 98 is a first prong 100, and extending upwardly from the opposing side of the bezel portion 98 is a second prong 102. The bottom member 96 has a bottom surface 104 which is substantially flat, and two opposing side wall surfaces 106, 108. The shape of the bottom member is that of a male dove tail joint member and thus is complimentary in shape to the inner space 93 defined in the track 68. Each of the side wall surfaces 106, 108 is transverse to, and at an angle other than 90° with respect to, both the plane in which the bottom surface 104 resides, which in FIG. 10 is shown as being horizontal, and with respect to the vertical (as the mounting member 72 is depicted in FIG. 10).

The bezel portion 98, as shown in FIG. 10, has substantially vertical side wall surfaces 110. The bezel portion 98 also has a first bottom surface 112, adjacent a first side of the bottom member 96, and a second bottom surface 114, adjacent the opposing second side of the bottom member 96. The bezel 98 also includes a top surface 116, which is preferably slightly curved.

The side wall surface 106 is at an angle $A_3$ with respect to the first bottom surface 112 of the bezel portion 98. The second side wall surface 108 is at an angle $A_4$ with respect to the second bottom surface 114 of the bezel portion 98. Preferably, angles $A_3$ and $A_4$ are identical, and are complimentary in nature to angles $A_1$ and $A_2$. Thus, the bottom member 96, which preferably has a width slightly less than the width $D_2$ of the slideable surface 92, will fit within the inner space 93 of the track 68. The bottom member 96 has a height depicted as $D_6$ in FIG. 10 and the bezel member has a height depicted as $D_7$ in FIG. 10. Preferably, $D_6$ and $D_7$ are substantially the same length.

Figure 11:
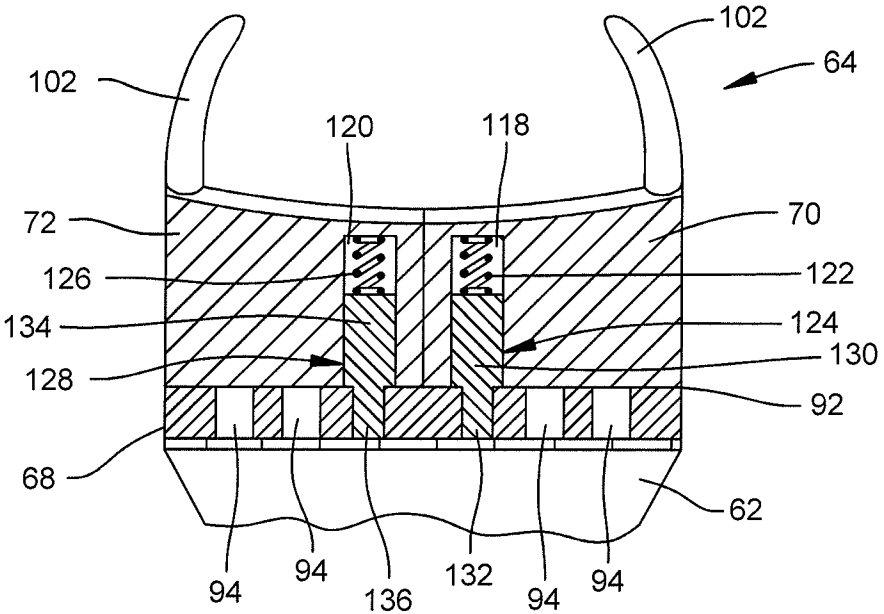
FIG. 11 is a cross-sectional view of the jewelry head of FIG. 6, taken along line XI-XI in FIG. 6.

As shown in FIG. 9, each of the mounting members 70, 72 have an aperture therein. First mounting member 70 includes aperture 118 and second mounting member 72 includes aperture 120. Aperture 118 receives a spring 122 and a portion of a pin 124. Aperture 120 receives a spring 126 and a portion of a pin 128. Pin 124 includes a top cylindrical portion 130 and a bottom portion 132. The bottom portion 132 has a diameter less than that of the top cylindrical portion 130. Pin 128 includes a top cylindrical portion 134 and a bottom portion 136. The bottom portion 136 has a diameter that is less than the diameter of cylindrical portion 134. As shown in FIG. 11, each of the first mounting member 70 and second mounting member 72 is placed within the inner space 93 of the track 68, such that the bottom surfaces 104 of the respective bottom members 96 rest on the slideable surface 92 of the track 68. In the first mounting member 70, spring 122 is inserted above pin 124 in the aperture 118. In the second mounting member 72, spring 126 is inserted above pin 128 in the aperture 120. The bottom portion 132 of pin 124 is positioned in an aperture 94 in the track 68 and the bottom portion 136 of pin 128 is positioned in a different aperture 94 of the track 68.

To change the size of the setting, the tip of a small awl or other similar tool is inserted through hole 66*a* in the shank 62 and into an aperture 94 where one of the pins, for instance pin

124, resides. Using the tool, the pin 124 is pressed upwards against the biasing strength of spring 122 to a position above the slideable surface 92 such that the first mounting member 70 can be slid along the slideable surface 92. Once the desired location is reached, the tool is removed, allowing the bottom portion 132 of pin 124 to drop into a different aperture 94, the biasing force of spring 122 pressing the pin downwardly and holding the pin 124 in the chosen aperture 94. The same procedure is then performed, if desired, for second mounting member 72 such that an appropriate distance between prongs 102 and between prongs 100 is achieved. A gemstone is then inserted into the claw made up of the prongs 100, 102 and the first mounting member and/or the second mounting member 70, 72 can be adjusted, if necessary, to create a tight fit for the gemstone. As desired, this gemstone may be removed and other gemstones inserted using the above procedure.

Alternatively, one of the mounting members 70, 72 is fixedly attached to either the track 68 or to a portion of the shank 62. The other of the mounting members 70, 72 is still moveable along the slideable surface 92, and with respect to the opposing mounting member, thus resulting in an adjustable head.

The casting and setting apparatus and procedure described above allows a user to use multiple gemstones, and swap them, in a single piece of jewelry without the cost of buying a new ring or other such jewelry item.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A piece of jewelry comprising:

a jewelry base member having a surface configured for attachment to a jewelry head, the surface having an aperture therein sized to allow a portion of an adjustment tool therethrough; and a jewelry head comprising:

a track member comprising a track base attached to the outer surface of the jewelry base member, the track member having a slideable surface, at least one wall member extending upwardly from the track base, and a plurality of holes extending through the track base, the track base and at least one wall member together creating a holding structure capable of receiving and retaining a portion of at least one mounting member, a first mounting member connected to either the jewelry base member or the track member, the first mounting member having a bezel portion and at least one prong extending outwardly from the bezel portion, a second mounting member having a bezel portion, at least one prong extending outwardly from the bezel portion, and a bottom that is slideable along the slideable surface of the track member, a pin moveably engaged with the second mounting member and engaged with one of the holes of the track base, and a biasing element which biases the pin toward the track base, the biasing element exerting a force which can be overcome to move the pin with respect to the track member to allow slideable movement of the mounting member with respect to the track member to adjust the setting size.

* * * * *